United States Patent [19]

Lounsbury, Jr. et al.

[11] Patent Number: 4,646,677

[45] Date of Patent: Mar. 3, 1987

[54] DISPOSABLE ROLLER FOR USE IN XEROGRAPHIC COPIER MACHINES

[75] Inventors: Charles W. Lounsbury, Jr., Canandaigua; Gary D. Graudons; Paul J. Rider, both of Shortsville, all of N.Y.

[73] Assignee: Sonoco Products Company, Hartsville, Darlington County, S.C.

[21] Appl. No.: 796,079

[22] Filed: Nov. 7, 1985

[51] Int. Cl.[4] ..... G03G 15/08; G03G 15/09

[52] U.S. Cl. ..... 118/653; 29/121.5; 29/128; 29/132; 118/658

[58] Field of Search ..... 118/653, 658; 29/121.5, 29/128, 132

[56] References Cited

U.S. PATENT DOCUMENTS

| | | |
|---|---|---|
| 2,874,063 | 2/1959 | Greig . |
| 3,367,008 | 2/1968 | Hoge . |
| 3,627,557 | 12/1971 | Ichi Sato et al. . |
| 3,906,896 | 9/1975 | Stansell . |
| 3,942,888 | 3/1976 | Maksymiak et al. . |
| 4,083,092 | 4/1978 | Imperial et al. . |
| 4,309,803 | 1/1982 | Blaszak . |
| 4,329,414 | 5/1982 | Suzuki . |
| 4,400,078 | 8/1983 | Mayer . |
| 4,412,733 | 11/1983 | Doutney . |
| 4,449,810 | 5/1984 | Ikesue et al. . |
| 4,451,133 | 5/1984 | Kopp et al. . |
| 4,478,505 | 10/1984 | Tashiro . |
| 4,478,512 | 10/1984 | Zoltner . |
| 4,487,496 | 12/1984 | Baier et al. . |
| 4,515,106 | 5/1985 | Kohyama . |

*Primary Examiner*—Bernard D. Pianalto

*Attorney, Agent, or Firm*—Bell, Seltzer, Park & Gibson

[57] ABSTRACT

A roller is characterized by an inexpensive and disposable construction for use in transporting and applying developer material in a developer system of a xerographic copier machine, and a method of fabricating such rollers. The rollers have an outside electrically-conductive surface for transporting and applying developer material and are constructed of a tubular fiber core, preferably spirally-wound and laminated paper plies, with an outside surface ply of aluminum foil spirally-wound on and laminated to the fiber core. At least those rollers which are utilized as applying rollers have spaced-apart grooves formed in the outside surface of the roller and formed therein without tearing or cracking the thin aluminum surface ply.

12 Claims, 9 Drawing Figures

DISPOSABLE ROLLER FOR USE IN XEROGRAPHIC COPIER MACHINES

FIELD OF THE INVENTION

This invention relates to a roller, characterized by an inexpensive and disposable construction, for use in transporting and applying developer material in a developer system of a xerographic copier machine, and a method of fabricating such rollers.

BACKGROUND OF THE INVENTION

In xerographic or electrophotographic copier machines, a photoconductive member is charged to a substantially uniform potential to synthesize the surface thereof. The charged portion of the photoconductive member is exposed to a light image of an original document being copied or reproduced. This records an electrostatic latent image on the photoconductive member corresponding to the informational areas contained within the original document. The latent image is then developed by bringing a developer material, usually powdered toner particles adhering triboelectrically to carrier granules, into contact therewith. The toner particles are attracted to the latent image from the carrier granules to form a powder image on the photoconductive member which is subsequently transferred to a copy sheet. Finally, the copy sheet is heated to permanently affix the powder image thereto in image configuration.

The developer material is brought into contact with the electrostatic latent image on the photoconductive member in a development system or station within such xerographic copier machine and such system or station utilizes rollers having outside electrically-conductive surfaces thereon for transporting and applying the developer material. These rollers often include elongated magnets positioned concentrically within the rollers and a voltage source attached thereto which electrically biases the rollers to a selected magnitude and polarity intermediate that of the background voltage and image voltage level recorded on the photoconductive member. These rollers are utilized in the development system as both transporting rollers for transporting the developer material through the development system or station and as applying rollers for applying the toner particles in the developer material to the electrostatic latent image on the photoconductive member as it passes by such applying rollers. Those rollers utilized in the development system as applying rollers usually include spaced-apart grooves in the outside surface of each of the rollers which extend longitudinally of the roller and cover the entire circumference of the roller for ensuring an even distribution of developer material along the roller for applying the toner particles to the electrostatic latent image on the photoconductive member.

Heretofore, these rollers, utilized in development systems of xerographic copier machines, have been for the most part constructed of solid aluminum or stainless steel. When such rollers begin to malfunction for their desired purpose in the xerographic copier machine operation, such rollers had to be removed from the machines, cleaned or otherwise replaced in the machines. This, as can be appreciated, was an expensive procedure due to the cost of solid aluminum or stainless steel rollers.

OBJECTS AND SUMMARY OF THE INVENTION

Accordingly, it is the primary object of this invention to eliminate the above problem and to provide an inexpensive and disposable roller construction for use in development systems of xerographic copier machines.

By this invention, this object was accomplished by providing rollers having outside electrically-conductive surfaces for transporting and applying developer material in a development system of a xerographic copier machine, each of which is constructed of a tubular fiber core, preferably spirally-wound and laminated paper plies, with an outside surface ply of aluminum foil spirally-wound on and laminated to the fiber core.

For those development system rollers of a xerographic copier machine utilized for applying developer material, spaced-apart grooves are formed in the outside surface of the roller extending longitudinally of the roller and cover the entire circumference of the roller for ensuring an even distribution of the developer material along the rollers. The roller further preferably includes portions of the outside surface ply of aluminum foil being rolled around each end of the tubular fiber core for providing electrically-conductive contacts between the ends of the rollers and the outside electrically-conductive surface of the rollers.

Although tubular fiber cores, formed by spirally-winding and laminating a plurality of paper plies, with outside and/or inside surface plies of aluminum foil wound on and laminated to the fiber core, have been utilized in other environments, such as containers and the like, such tubular fiber cores with outside surface plies of aluminum foil have not heretofore been utilized as rollers for transporting and applying developer materials in xerographic copier machines. Indeed, when the inventors of the present invention discussed the possibility of such construction being utilized as rollers for transporting and applying developer materials in development systems of xerographic copier machines with copier machine manufacturers, they were discouraged from experimenting with such construction of a roller because of the belief that the spirally-wound aluminum foil ply on the outside of the tubular fiber core would probably direct all of the developer material to one end of the roller in light of the spiral groove resulting from the spiral winding of the aluminum foil outside ply. Also, it was not considered possible to form the longitudinal grooves in the roller without tearing or cracking the thin aluminum foil outside surface ply.

Nevertheless, the inventors of the present invention found that the spiral groove in the aluminum foil outside ply did not adversely affect distribution of the developer material along the roller and experimented with many different methods of forming the grooves without tearing the aluminum foil surface ply. The experiments included forcing of the fiber cores with aluminum foil outside ply laminated thereon through a knurled die having pointed edges to form grooves or score lines on the outside surface of the tube. However, this procedure did not produce the desired results since the sharp edges of the knurls cut the thin aluminum foil layer. Next, the inventors experimented with forming grooves on the outside surface by the use of a knurling die pressed against the outside surface of the rollers and rotated therearound under pressure. This also did not produce a satisfactory result in that the grooves were very shallow and the knurling die still cut the thin aluminum foil ply. The inventors then conceived of the novel concept of forming the spaced-apart grooves in the rollers by providing a ring die having a round coil spring fitted to and forming an inside surface in the ring die of a predetermined diameter and forcing the rollers through the ring die so that the rounded surfaces of the coil spring would form generally U-shaped grooves in the roller without tearing or cracking the aluminum foil surface ply.

Thus, there has been produced by this invention a method of fabricating and a resulting roller construction, which is characterized by being inexpensive and disposable, which can be utilized in development systems of xerographic copier machines and which eliminates the necessity of utilizing expensive solid aluminum or stainless rollers.

BRIEF DESCRIPTION OF THE DRAWINGS

Some of the objects and advantages of this invention having been stated, other objects and advantages will appear in the detailed description of a preferred embodiment of this invention, when taken in conjunction with the accompanying drawings, in which.

DESCRIPTION OF PREFERRED EMBODIMENT OF THE INVENTION

Figure 1:
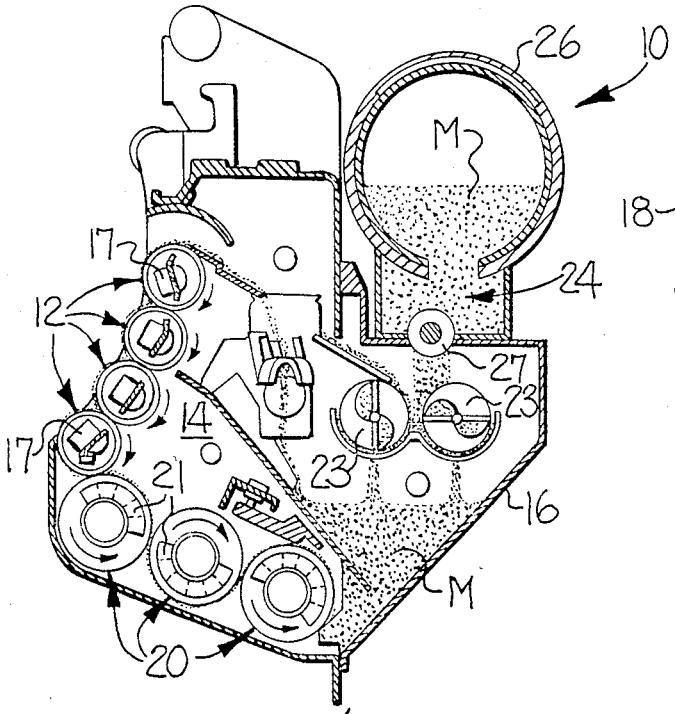
FIG. 1 is a schematic elevational view showing a development system of a xerographic copier machine utilizing the improved roller construction of this invention therein.

As discussed above, this invention relates to a roller construction and method of manufacturing same for use in transporting and applying developer material in a developer system of a xerographic copier machine. A complete illustration of such a copier machine has not been set forth in the drawings hereof and is not believed to be necessary for a complete understanding of the present invention. For background purposes, reference may be had to U.S. Pat. No. 4,478,512, issued Oct. 23, 1984, and assigned to Xerox Corporation of Stamford, Conn., for an illustration of an exemplary xerographic or electrophotographic copier machine.

As may be seen in the disclosure of this U.S. patent, a photoconductive member or drum is charged to a substantially uniform potential to synthesize the surface thereof and the charged portion of the photoconductive member is exposed to a light image of an original document being copied or reproduced. An electrostatic latent image is recorded on the photoconductive member corresponding to the informational area contained on the original document. This latent image is then developed by bringing a developer material, usually powdered toner particles mixed with carrier granules, into contact therewith. The toner particles are attracted to the latent image from the carrier granules to form a powder image on the photoconductive member which is subsequently transferred to a copy sheet. The copy sheet is heated to permanently affix the powder image thereto and image configuration to produce a xerographic copy of the original document.

The developer material is brought into contact with the electrostatic latent image on the photoconductive drum member in a development system or station within such xerographic copier machine as the drum member is rotated past the development system. This development station or system, broadly indicated at the reference numeral 10, is illustrated in FIG. 1 and corresponds to that illustrated in the aforementioned U.S. Pat. No. 4,478,512.

As also described in the aforementioned U.S. patent but with different reference numerals being utilized, such development system includes a plurality of developer material applying rollers 12, each of which is substantially identical. All of these applying rollers 12 are mounted in a chamber 14 of housing 16. Each roller 12 is tubular, suitably journaled for rotation, have heretofore been constructed of stainless steel (as set forth in the aforementioned patent) or aluminum to provide an electrically-conductive outside surface, and have roughened or grooved surfaces. An elongated magnet 17 is positioned concentrically within the tubular roller 12 and spaced from the interior circumferential surface thereof and preferably made from barium ferrite or other suitable material.

Figure 2:
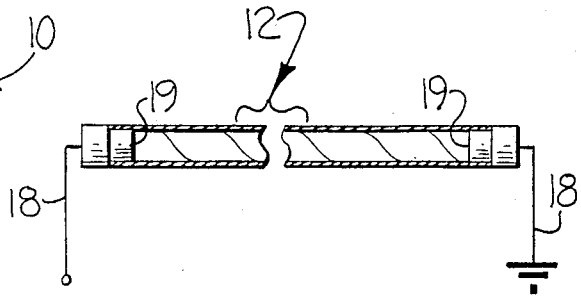
FIG. 2 is a schematic view of the roller of this invention, as used in the development system of FIG. 1, showing electrical contacts with the ends of the roller.

A voltage source 18 is suitably connected by end plugs 19 to each end of the roller 12 to provide electrical contact with each end of the roller 12 and an electrical current along the electrically-conductive surface of the roller 12, as shown in FIG. 2, to electrically bias each of the developer rollers 12 to a selected magnitude and polarity. Preferably, the magnitude of the electrical bias is to a level intermediate that of the background voltage and image voltage level recorded on the photoconductive surface of the photoconductive member discussed above. The rollers 12 rotate in the directions of the arrows shown in FIG. 1 to advance developer material, indicated at M, closely adjacent to the photoconductive surface of the drum which rotates in close proximity to the developer system 10, as shown in the aforementioned patent. In this way, the toner particles in the developer material M are attracted from the carrier granules to form a toner powder image on the photoconductive surface corresponding to the informational areas contained within the original document.

The development system 10 further includes a plurality of developer material transporting rollers 20 for transporting the developer material M to the applying rollers 12. Each of these transporting rollers 20 are also tubular and were previously constructed from stainless steel (as described in the aforementioned patent) or aluminum to provide electrically-conductive outside surfaces. These transporting rollers 20 rotate in the direction of the arrows thereon. Magnets 21 are disposed interiorly of each of the rollers 20.

A pair of mixing augers 23 mix fresh toner particles discharged from a dispenser 24 with carrier unused developer material M being returned to the chamber 14 of housing 16, in the manner illustrated in FIG. 1. Dispenser 24 includes a housing 26 for receiving a toner cartridge and a foam roller 27 is disposed in the opening of the housing 26 to dispense toner particles therefrom. In operation, toner cartridge 26 is inserted into the housing of the toner dispenser 24 and roller 27 disperses toner particles onto augers 23. These augers 23 mix the freshly dispensed toner particles with the unused developer M to form fresh developer material M which is fed to chamber 14 of housing 16. The transporting rollers 20 advance the freshly mixed developer material M to applying rollers 12 which move the developer material M closely adjacent to the photoconductive surface for applying the toner particles to the photoconductive surface, as discussed above.

In accordance with this invention, the developer material applying rollers 12 and transporting rollers 20 are constructed in a manner to be described below and which is characterized by an inexpensive and disposable construction for replacing the much more expensive and nondisposable stainless steel or aluminum rollers in the development system 10. These applying and transporting rollers 12, 20 are constructed substantially the same, except for one difference to be pointed out hereinafter, and accordingly, the description will be primarily directed to the construction and method of fabricating the applying roller 12.

Figure 3:
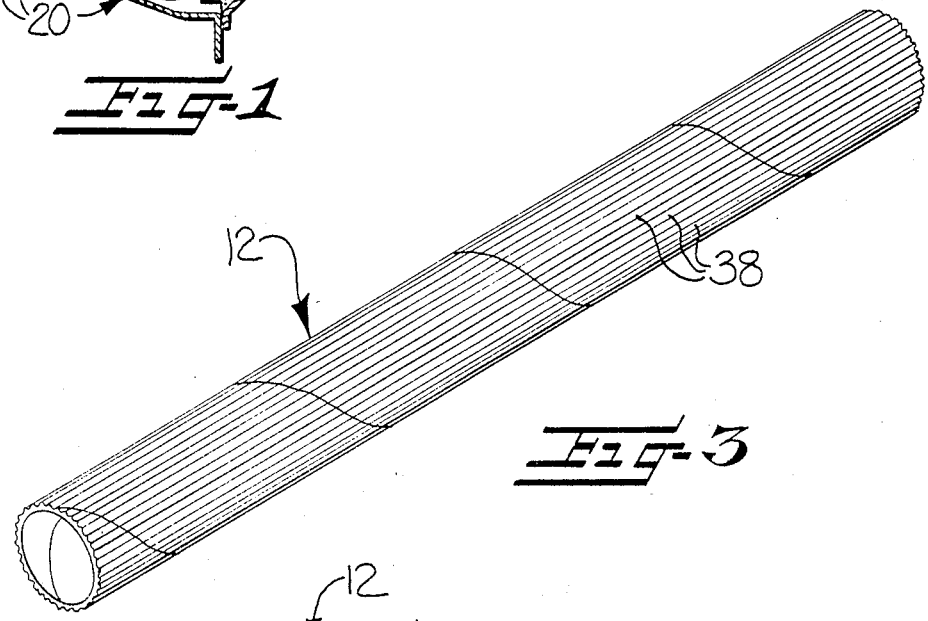
FIG. 3 is a perspective view of a roller constructed in accordance with this invention.
Figure 4:
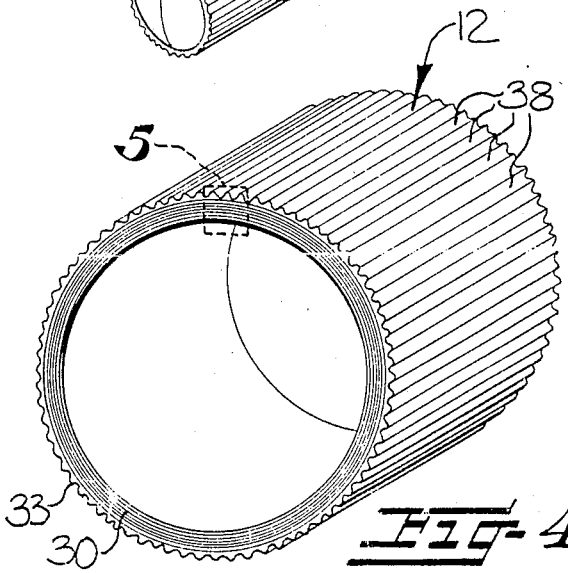
FIG. 4 is an enlarged perspective view of a portion of the roller of FIG. 3 and showing one end thereof.
Figure 5:
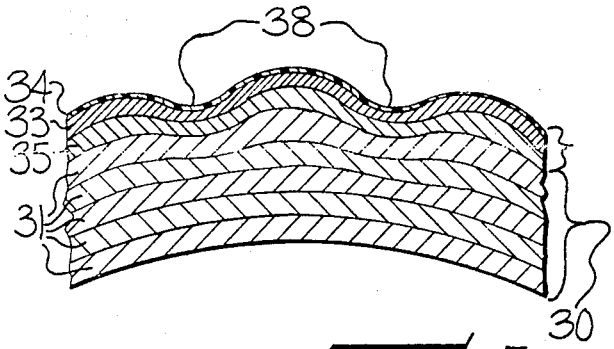
FIG. 5 is an enlarged cross-sectional view, taken generally within the dotted line 5 of FIG. 4.

As shown in FIGS. 3–5, this roller 12 comprises a tubular fiber core 30, preferably including a plurality of paper plies 31 spirally-wound and laminated together, as described in more detail below. The roller 12 further includes an outside ply of aluminum foil 33 spirally-wound on and laminated to the fiber core 30 in a manner to be described below. A vinyl coating 34 is provided over the surface ply of aluminum foil ply 33. The aluminum foil ply 33 provides an electrically-conductive outside surface to the roller 12 and the vinyl coating aids in operation of the roller in the development system of the xerographic copier machine. If desired, an aluminum foil laminate is commercially available which includes a layer of very thin paper 35, a layer aluminum foil 33 and a vinyl coating 34 already laminated together which can be spirally-wound and laminated to the outside surface of the paper core 30.

The roller 12 further includes spaced-apart grooves 38 in the outside surface thereof which extend longitudinally of the roller 12 and cover the entire circumference of the roller 12 for ensuring an even distribution of the developer material M along the roller. Preferably, these grooves are U-shaped in cross-section to aid in such distribution of developer material.

The above described grooves 38 appreciably aid in use of the roller 12 as an applying roller in the development system 10 of a xerographic copier machine. However, these grooves 38 are not absolutely essential when the rollers are utilized as developer material transporting rollers 20 and, therefore, the grooves 38 may be eliminated from the construction of the roller when it is utilized as a transporting roller 20.

Figure 6:
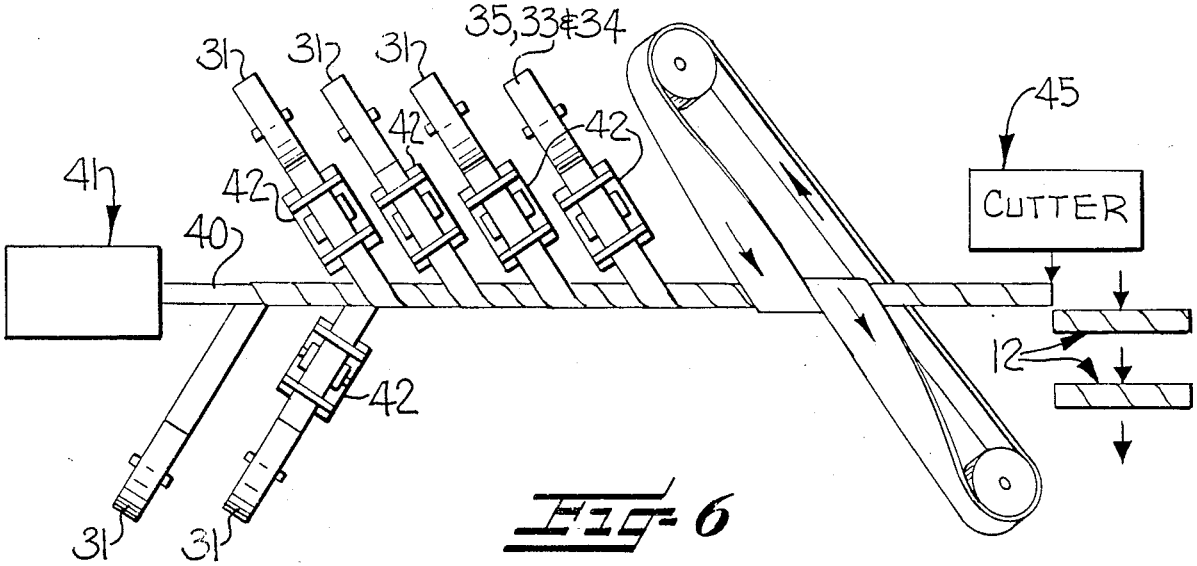
FIG. 6 is a schematic plan view illustrating some of the process steps of fabricating a roller in accordance with this invention including spirally winding and laminating a plurality of paper plies to form a tubular fiber core, spirally winding and laminating a surface ply of aluminum foil thereon, and cutting of the thus formed roller into desired lengths.

Referring now to FIGS. 6–9 which relate to the method of fabricating the roller 12 illustrated in FIGS. 3–5, a plurality of paper plies 31 are fed from suitable supply rolls to the mandril 40 of a suitable spiral tube winding machine, generally indicated at 41 illustrated schematically in FIG. 6. Each of the plies of paper 31 are fed past glue applying devices 42 prior to being spirallywound on each other on the mandril 40 for suitable lamination to each other to form the fiber core 30. The foil ply 33, or foil laminate consisting of a paper layer 35, foil layer 33 and vinyl coating 34, is fed from a suitable supply roll past a glue applicator 42 to be spirally-wound on the previously formed fiber core 30 on the mandril 40 of the spiral tube winding machine 41 to form roller 12. These spiral tube winding machines are well understood by those with ordinary skill in the art and further details of the construction and operation thereof are not believed necessary herein for a full understanding of the present invention.

Figure 7:
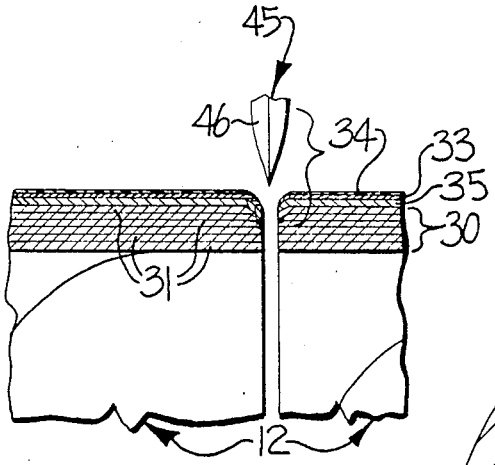
FIG. 7 is a schematic view further illustrating the fabricating step of cutting the rollers into desired lengths while rolling the outside surface ply of aluminum around the cut ends of the tubular fiber core.

As the thus formed spirally wound roller 12 is fed forwardly on the mandril 40, a cutter mechanism, schematically indicated at 45, cuts the roller 12 into desired lengths. This cutter mechanism 45 includes a suitable blade 46, as shown in FIG. 7, which has a wide cutting surface thereon to engage and cut the rollers 12, while rolling the outside surface ply of the aluminum foil ply 33 around the cut ends of the tubular fiber core or roller 12 for providing the electrically-conductive contacts at the ends of the roller 12 to the outside electrically-conductive surface of the roller 12 provided by the aluminum foil ply 33, for the purposes discussed above.

Figure 8:
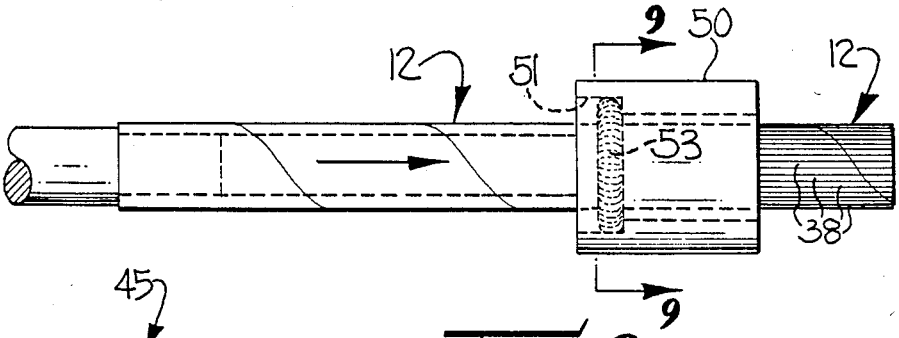
FIG. 8 is a plan view of the fabricating step of forming grooves in the outside surface of the rollers by forcing the roller through a ring die having a rounded coil spring therein.
Figure 9:
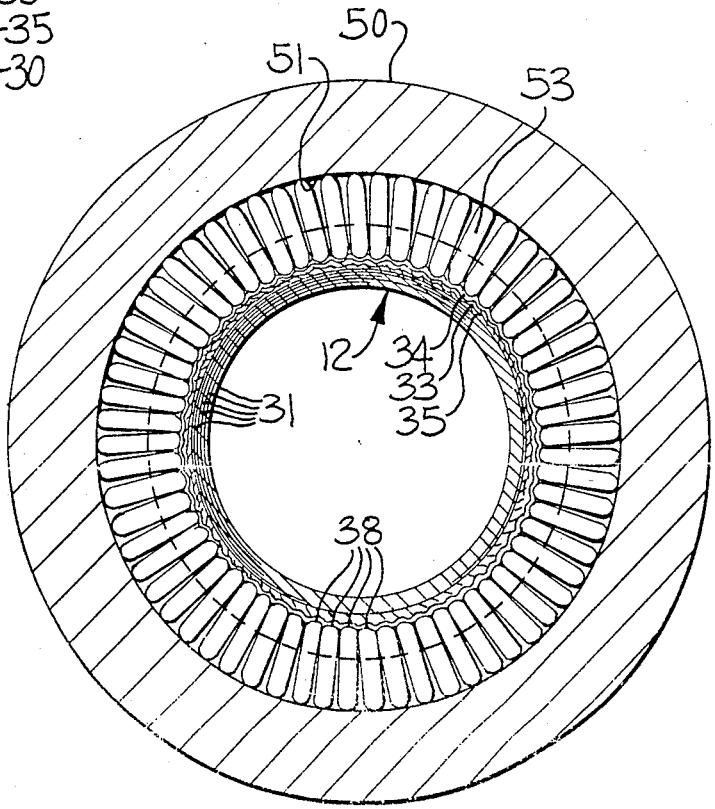
FIG. 9 is an enlarged sectional view, taken generally along the line 9—9 of FIG. 8.

As shown in FIGS. 8 and 9, the spaced-apart U-shaped grooves 38 are formed in the roller 12 by providing a ring die 50 having a cavity 51 therein for receiving a round coil spring 53 fitted to and forming an inside surface in the ring die of a predetermined diameter slightly less than that of the roller 12 as it comes off of the spiral tube winding machine mandril 40 after being cut by the cutter mechanism 45. The tube 12 is forced through the ring die 50 and the inside surface thereof formed by the round coil spring 53 in any suitable manner so that the rounded surfaces of the coils of the spring 53 will form the generally U-shaped grooves in the roller 12, as schematically illustrated in FIGS. 8 and 9. The round surfaces of the coils of the spring 53 will form such generally U-shaped grooves in the roller 12 without tearing or cracking the aluminum foil surface ply 33 or the vinyl coating 34 thereon so as to retain the electrically-conductive surface on the outside of the roller 12 to function in the developer system 10 of a xerographic copier machine.

Therefore, this invention has provided a roller construction and method of fabricating same which may be utilized in transporting and applying developer material in a developer system of a xerographic copier machine which is characterized by being inexpensive and disposable.

In the drawings and specification there has been set forth a preferred embodiment of this invention, and although specific terms are employed, they are used in a generic and descriptive sense only and not for purposes of limitation, the scope of the invention being defined in the following claims.

What is claimed is:

1. In a xerographic copier machine having a development system utilizing rollers therein having outside electrically-conductive surfaces for transporting and applying developer material; the improvement of at least one of said rollers being utilized for applying developer and characterized by an inexpensive and disposable construction comprising:

a tubular fiber core, an outside surface ply of aluminum foil spirally wound on and laminated to said fiber core, and spaced-apart grooves in said outside surface of said roller extending longitudinally of said roller and covering the entire circumference of said roller for ensuring an even distribution of developer material along said roller.

2. In a xerographic copier machine, as set forth in claim 1, in which tubular fiber core comprises a plurality of spirally-wound paper plies.

3. In a xerographic copier machine, as set forth in claim 1, in which said grooves are generally U-shaped in cross-section.

4. In a xerographic copier machine, as set forth in claim 1, in which said outside surface ply of aluminum foil includes portions rolled around each end of said tubular fiber core for providing electrically-conductive contacts between the ends of said roller and said outside electrically-conductive surface of said roller.

5. In a xerographic copier machine, as set forth in claim 1, in which said roller further include a vinyl coating over said surface ply of aluminum foil.

6. A roller having an electrically-conductive outside surface adapted for use in a xerographic copier machine having a development system utilizing such rollers for applying developer material and being characterized by an inexpensive and disposable construction, said roller comprising:

a tubular fiber core comprising a plurality of spirally-wound paper plies, an outside ply of aluminum foil spirally-wound on and glue laminated to said fiber core, a vinyl coating over said surface ply of aluminum foil, and spaced-apart grooves being U-shaped in cross section in said outside surface of said roller extending longitudinally of said roller and covering the entire circumference of said roller for ensuring an even distribution of developer material along said roller when said roller is utilized in a development system of a xerographic copier machine.

7. In a xerographic copier machine having a development system utilizing rollers therein having outside electrically-conductive surfaces for transporting and applying developer material; the improvement of each of said rollers being characterized by a relatively inexpensive and disposable construction comprising:

a tubular fiber core comprising a plurality of spirally-wound paper plies, an outside surface ply of aluminum foil spirally-wound on and glue laminated to said fiber core, and a vinyl coating over said surface ply of aluminum foil, and wherein at least those rollers utilized for applying developer material further include spaced-apart grooves being U-shaped in cross section in said outside surface of said rollers extending longitudinally of said rollers and covering the entire circumference of said rollers for ensuring an even distribution of developer material along said rollers.

8. A roller having an electrically-conductive outside surface adapted for use in a xerographic copier machine having a development system utilizing such rollers for applying developer material and being characterized by an inexpens1ve and disposable construction, said roller comprising:

a tubular fiber core, an outside surface ply of aluminum foil spirally-wound on and laminated to said fiber core, and spaced-apart grooves in said outside surface of said roller extending longitudinally of said roller and covering the entire circumference of said roller for ensuring an even distribution of developer material along said roller when utilized in a development system of a xerographic copier machine.

9. A roller, as set forth in claim 8, in which said grooves are generally U-shaped in cross section.

10. A roller, as set forth in claim 8, in which said outside surface ply of aluminum foil includes portions rolled around each end of said tubular fiber core for providing electrically-conductive contacts between the ends of said roller and said outside electrically-conductive surface of said roller.

11. A roller, as set forth in claim 8, further including a vinyl coating over said surface ply of aluminum foil.

12. A roller, as set forth in claim 8, in which said tubular fiber core comprises a plurality of spirally-wound paper plies.

* * * * *